United States Patent [19]

Takahashi

[11] 4,095,123

[45] June 13, 1978

[54] SWITCH CONTROLLER

[75] Inventor: Naoyuki Takahashi, Hino, Japan

[73] Assignee: Olympus Optical Co., Ltd., Tokyo, Japan

[21] Appl. No.: 790,841

[22] Filed: Apr. 25, 1977

[30] Foreign Application Priority Data

Jun. 28, 1976 Japan ..... 51-84860[U]

[51] Int. Cl.[2] ..... H01H 3/12

[52] U.S. Cl. ..... 307/115; 307/113; 200/153 C; 200/86.5; 200/6 A; 200/5 C

[58] Field of Search ..... 200/153 C, 153 T, 86.5, 200/52 R, 159 R, 307, 340, 18, 6 A, 5 C, 5 E; 307/112, 113, 115

[56] References Cited

U.S. PATENT DOCUMENTS

| | | | |
|---|---|---|---|
| 3,482,072 | 12/1969 | Taylor | 200/159 R |
| 3,506,795 | 4/1970 | Schmidt | 200/5 C |
| 3,980,848 | 9/1976 | Schulz | 200/86.5 |
| 4,045,630 | 8/1977 | McCarthy | 200/DIG. 2 |

*Primary Examiner*—Gerald P. Tolin

*Attorney, Agent, or Firm*—Louis Weinstein

[57] ABSTRACT

A controller comprises a first and a second pushbutton each carrying a pair of actuator pins of different lengths, first and second normally open switches located below each of the actuator pins having a reduced length, and a first and a second normally closed switch located below each of the other actuator pins. When depressed, each pushbutton causes its pin of an increased length to actuate its associated switch initially and then causes the other pin to actuate its associated switch. When the first pushbutton is depressed, a first circuit including the first normally open switch and the second normally closed switch in series is completed, and when the second pushbutton is depressed, a second circuit including the first normally closed switch and the second normally open switch in series is completed. When neither pushbutton is depressed, the first and second normally open switches prevent either the first or the second circuit from being completed. When the both pushbuttons are depressed simultaneously, the first and second normally closed switches are opened, thus preventing the completion of both the first and the second circuits.

4 Claims, 3 Drawing Figures

SWITCH CONTROLLER

BACKGROUND OF THE INVENTION

The invention relates to a switch controller which is adapted to prevent an inadvertent operation of a foot-operated switch controller as used in a surgical microscope for controlling the vertical movement of the microscope body or for controlling the focussing.

When using a surgical microscope to permit an observation of an affected part on a magnified scale while undertaking a surgical operation, both hands are occupied for the purpose of performing the surgical operation and hence are unavailable to performing the focussing, for example. To overcome this difficulty, there is provided a surgical microscope which may be automatically operated by foot.

However, a foot-operated controller is liable to an inadvertent operation. By way of example, the controller may include a pair of pushbuttons disposed in juxtaposition, one serving to move the microscope upward and the other downward. When one of these pushbuttons is to be depressed by foot, both of them may be depressed simultaneously.

SUMMARY OF THE INVENTION

It is an object of the invention to provide a switch controller which completely eliminates the likelihood of inadvertent operation, by using a combination of normally open switches and normally closed switches such that the simultaneous depression of two pushbuttons cannot complete either circuit.

DESCRIPTION OF PREFERRED EMBODIMENT

Figure 1:
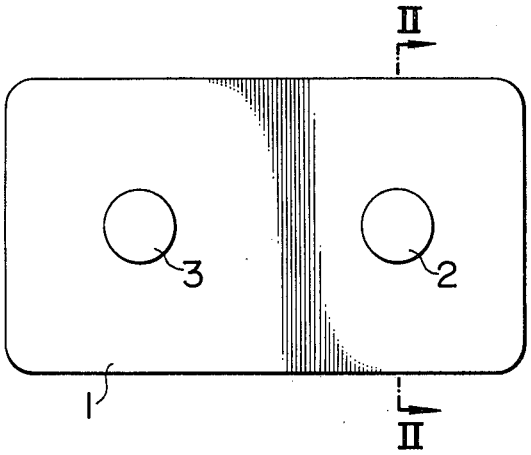
FIG. 1 is a plan view of the controller of the invention.
Figure 2:
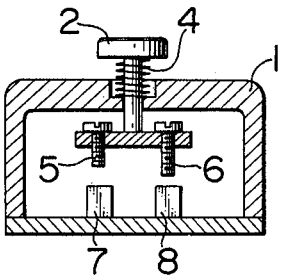
FIG. 2 is a cross section taken along the line II—II shown in FIG. 1.

The switch controller according to the invention will be described below as applied to a foot-operated switch controller associated with a microscope. Referring to FIGS. 1 and 2, the controller includes a body 1 having a pair of first and second pushbuttons 2, 3 mounted therein. These pushbuttons are arranged so that the depression of the pushbutton 2 moves a microscope body upward while the depression of the pushbutton 3 moves the microscope body downward. A spring 4 normally biases the pushbutton 2 upward. While not shown, a similar spring biases the pushbutton 3 upward. The pushbutton 2 has a pair of actuator pins 5, 6 secured to its inner end. The pin 6 is longer than the pin 5. A first normally open microswitch 7 and a first normally closed microswitch 8 are located below the pins 5 and 6, respectively. In a similar manner, the pushbutton 3 carries a pair of actuator pins, with an actuator pin of a reduced length located in alignment with the pin 5 and an actuator pin of an increased length located in alignment with the pin 6. A second normally open microswitch 9 and a second normally closed microswitch 10 (see FIG. 3) are located below the pins on the pushbutton 3. When the pushbutton 2 is depressed by foot, the actuator pin 6 initially actuates the microswitch 8, and thereafter the pin 5 actuates the microswitch 7. Similarly, when the pushbutton 3 is depressed, the microswitch 10 (see FIG. 3) located below the longer pin is initially actuated, and then the microswitch 9 located below the shorter pin is actuated. It is to be noted that the microswitches 7,9 located below the shorter pins are normally open switches while the microswitches 8, 10 located below the longer pins are normally closed switches.

Figure 3:
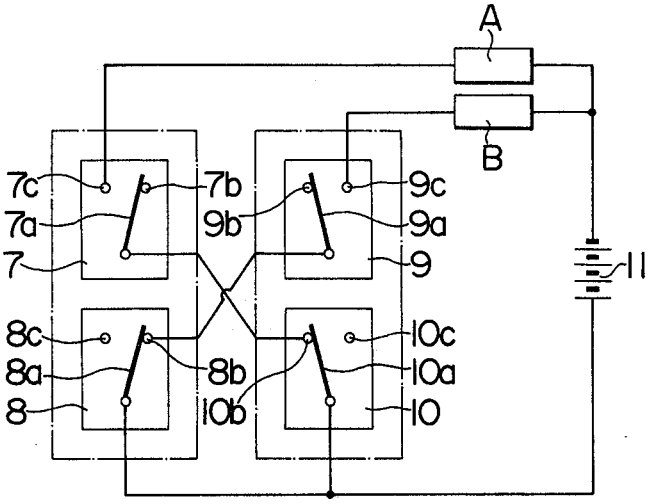
FIG. 3 is a circuit diagram showing the electrical connection of switches contained in the controller.

Referring to FIG. 3 where similar parts are designated by like numerals, there is shown a first circuit which includes a drive A for moving a microscope body vertically upward. A second circuit includes a drive B which moves the microscope body vertically downward. The first normally open switch 7 and the second normally closed switch 10 are connected in series with the drive A in the first circuit. The first normally closed switch 8 and the second normally open switch 9 are connected in series with the drive B in the second circuit.

When it is desired to move the microscope body upward, the pushbutton 2 may be depressed. This causes the longer pin 6 to actuate the microswitch 8. The microswitch 8 has its movable contact 8*a* switched from a terminal 8*b* to terminal 8*c*. Subsequently, the shorter pin 5 actuates the microswitch 7, whereby its movable contact 7*a* is switched from terminal 7*b* to 7*c*. As a result, the first circuit is completed to connect the drive A with a power source 11, moving the microscope body upward.

When the pushbutton 3 is depressed, the microswitch 10 is initially actuated, and its movable contact 10*a* is switched from terminal 10*b* to terminal 10*c*. Subsequently, the microswitch 9 is actuated, switching its movable contact 9*a* from terminal 9*b* to terminal 9*c*. As a result, the second circuit is completed to connect the drive B with the source 11, moving the microscope body downward.

When both pushbuttons are inadvertently depressed simultaneously, the longer pins initially actuate the microswitches 8 and 10. The movable contact 8*a* is switched to terminal 8*c*, and the movable contact 10*a* is switched to terminal 10*c*. The shorter pins then actuate the microswitches 7 and 9. The movable contact 7*a* is switched to terminal 7*c* and the movable contact 9*a* is switched to terminal 9*c*. Although the microswitches 7 and 9 are closed, the opening of the microswitches 8 and 10 prevents both the first and the second circuits from being completed.

It will be seen from the foregoing that an inadvertent operation of the switch controller of the invention does not result in completing any drive. Also it will be understood that the switch controller is equally applicable to any other operation of the microscope such as the focussing of the objective.

What is claimed is:

1. A switch controller comprising a first and a second pushbutton each carrying a pair of actuator pins of different lengths, first and second normally open switches respectively located below each shorter one of the actuator pins, and first and second normally closed switches respectively located below each longer one of the actuator pins, the first normally open switch and the second normally closed switch being connected in series in a first controlled circuit, and the first normally closed switch and the second normally open switch being connected in series in a second controlled circuit.

2. A switch controller according to claim 1 in which the first and second pushbuttons are spring biased away from the switches and are adapted to be operated by foot.

3. The switch controller of claim 1 wherein said first and second controlled circuits each include a drive means for mutually exclusive operation by said pushbuttons.

4. A switch controller comprising first and second pushbuttons;

a first normally open switch and a second normally closed switch;

first operating means for initially opening said second switch and for subsequently closing said first switch when said first pushbutton is operated;

a third normally open switch and a fourth normally closed switch;

second operating means for initially opening said fourth switch and for subsequently closing said third switch when said second pushbutton is operated;

a first control circuit including a power source a load device and said first and fourth switches;

a second control circuit including said power source a second load device and said second and third switches whereby said second circuit is initially opened and said first circuit is subsequently closed when said first pushbutton is operated;

said first circuit is initially opened and said second circuit is subsequently closed when said second pushbutton is operated;

and said first and second circuits are opened whenever said first and second pushbuttons are operated substantially simultaneously.

* * * * *